US006923535B2

(12) United States Patent
Koga

(10) Patent No.: US 6,923,535 B2
(45) Date of Patent: Aug. 2, 2005

(54) PRINTER WITH REINFORCING COVER AND INK TUBE FIXING PORTIONS

(75) Inventor: Yuji Koga, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 91 days.

(21) Appl. No.: 10/624,642

(22) Filed: Jul. 23, 2003

(65) Prior Publication Data

US 2004/0125180 A1 Jul. 1, 2004

(30) Foreign Application Priority Data

Jul. 26, 2002 (JP) ..... 2002-217952

(51) Int. Cl.[7] ..... B41J 2/175; B41J 29/13; B41J 2/325

(52) U.S. Cl. ..... 347/108; 347/85; 347/222

(58) Field of Search ..... 347/84–87, 108, 347/222

(56) References Cited

U.S. PATENT DOCUMENTS 3,373,435 A * 3/1968 Strong ..... 346/140.1
4,872,026 A * 10/1989 Rasmussen et al. ..... 347/56
5,831,656 A * 11/1998 Chosa ..... 347/108
6,789,882 B2 * 9/2004 Hiramatsu et al. ..... 347/84

* cited by examiner

*Primary Examiner*—Manish S. Shah
*Assistant Examiner*—Geoffrey Mruk
(74) *Attorney, Agent, or Firm*—Oliff & Berridge, PLC

(57) ABSTRACT

A recording unit frame, in which a recording unit is to be mounted, includes a frame and a cover body. The frame surrounds a scanning area of a carriage in which recording onto a recording sheet is performed by a print head, and accommodates a guide mechanism and a carriage moving mechanism. The frame has at least an opening on its top. The cover body is fixedly attached to the frame so as to block a part of the opening of the frame. The cover body has a window that enables a user to have access to a recording sheet in the frame. With these structures, the recording unit can be shrunk in height without losing its rigidity and strength, thereby providing a printer capable of maintaining high print quality.

19 Claims, 9 Drawing Sheets

PRINTER WITH REINFORCING COVER AND INK TUBE FIXING PORTIONS

BACKGROUND OF THE INVENTION

1. Field of Invention

The invention relates to a printer and, more particularly, to an improved structure of a recording unit including a frame in which a print head performs recording onto a recording sheet.

2. Description of Related Art

A known printer is provided with a recording unit, which is made up of a print head, a carriage that carries thereon the print head, a guide mechanism that guides the carriage movably in a main scanning direction, and a carriage moving mechanism that moves the carriage in the main scanning direction. In most cases, a pair of side frames and a main frame, connecting the side frames, are assembled so as to form the shape of substantially an angular C letter, and a platen that supports a recording sheet being printed is disposed between the side frames. The main frame is provided with the carriage moving mechanism and one of the side frames is provided with a sheet conveying mechanism that feeds recording sheets to be printed and ejects them out of the printer.

In such a printer where, for example, a recording sheet is fed so as to pass under the print head within the frame and the print head prints downwardly onto the recording sheet, the top of the frame is an opening. When a paper jam occurs, a user has access to the paper jamming in the frame from the opening and can clear the paper jam.

In an ink-jet printer where ink cartridges for supplying ink to the print head are mounted on the carriage, the frame becomes high. Therefore, even when the frame is open-topped, rigidity and strength of the frame are sustainable. However, the height of the recording unit increases, so that it is difficult to shrink the height of the printer.

On the other hand, in an ink-jet printer where the ink cartridges are fixedly placed outside the recording unit and ink is supplied from the ink cartridges to the print head via ink tubes, the ink cartridges are not mounted on the carriage. Therefore, this is very advantageous in decreasing the height of the printer, however, the rigidity and strength of the frame are decreased as a matter of course.

SUMMARY OF THE INVENTION

When rigidity and strength of a recording unit frame are low, the frame of the recording unit, which is fixed to a frame attaching portion of a printer, may become kinked or twisted. For example, a moving path of a print head may deviate from its normal moving path, thereby causing a reduction in print quality on a recording sheet by the print head. To shrink the recording unit in height, it is conceivable to enhance the rigidity and strength of the recording unit by blocking the top surface of the frame comprising the side frames and the main frame. However, paper jam clearing and print head replacement may become difficult. If an opening is merely defined in the top surface of the frame of the recording unit, to enable paper jam clearing and print head replacement, it is difficult to sufficiently enhance the rigidity and strength of the frame.

In a printer in which ink cartridges are not mounted on the carriage, ink tubes extending from the ink cartridges to the print head are disposed within the frame of the recording unit. Especially when the height of the recording unit is decreased, it is difficult to dispose the ink tubes within the recording unit in order to keep out of the way of the carriage's sideways movement.

The invention provides a printer that can ensure high rigidity and strength of a frame of a recording unit even in a printer, of which the size is shrunk, to maintain print quality. The invention also provides a printer that can facilitate paper jam clearing, and a printer where ink tubes, which extend from ink cartridges disposed outside the recording unit to a print head, can be arranged in an orderly manner within a frame of a recording unit.

According to one aspect of the invention, a printer may include a recording unit that includes a print head that prints onto a recording sheet, a carriage that has the print head thereon, a guide mechanism that guides and supports the carriage in a main scanning direction, and a carriage moving mechanism that moves the carriage in the main scanning direction. The recording unit may include a frame that surrounds a scanning range of the carriage in which the print head performs printing onto a recording sheet, the frame to which the guide mechanism and the carriage moving mechanism are attached and that has at least an opening on a top thereof, and a cover body that is fixed to the frame, such as to block a part of the opening of the frame, and that has a window that enables a user to have access to a recording sheet within the frame.

Recording onto a recording sheet is made by the print head within the frame of the recording unit. The frame has at least one opening on its top surface, and the cover body that blocks a part of the opening is fixed to the frame. When a paper jam occurs, it is possible for the user to have access to the recording sheet jam within the frame of the recording unit from the window of the cover body to clear the paper jam. Further, the print head can be replaced via the window.

As the cover body is fixed to the frame so as to block a part of the opening of the frame, the frame is reinforced at a place other than the window of the cover body, thereby enhancing the rigidity and strength of the frame and the cover body. Especially, even when the height of the recording unit is decreased, the rigidity and strength of the frame can be maintained. Thus, if the frame of the recording unit is fixed to a mounting frame of the printer, the tendency to form a kink in the frame is reduced, so that the moving path of the print head can be normalized, thereby maintaining high print quality.

Preferably, the printer according to the invention may be structured such that an ink cartridge mounting portion, to which an ink cartridge that supplies ink to the print head is mounted, may be provided outside of the recording unit, and a fixing portion that fixes a middle of a flexible ink tube extending from the ink cartridge to the print head may be placed inside the recording unit in such a manner that the ink tube may be curved from the fixing portion and extend to the print head.

The ink cartridge is mounted to the ink cartridge mounting portion disposed outside the recording unit, and ink is supplied from the ink cartridge to the print head via the ink tube. The ink tube is disposed such that the middle of the ink tube is fixed at the fixing portion provided inside the recording unit and the ink tube is curved from the fixing portion and extends to the print head. In other words, the ink tube can be arranged neatly inside the frame of the recording unit so as not to interfere with the sideways movement of the carriage, and the print head.

As compared with a printer in which an ink cartridge sits atop a carriage, the printer of the invention can be shrunk in its height by reducing the height of the recording unit. Decreasing the height of the recording unit may reduce the rigidity and strength of the frame. However, the cover body is fixed to the frame to maintain high rigidity and strength of the frame (and the cover body), thereby reducing the tendency to form a kink, or twist, in the frame and providing high print quality.

Preferably, in the printer according to the invention, an end portion of the window of the cover body with respect to the main scanning direction may be formed in a round shape similar to a curve in the ink tube approaching the end portion of the window. Thus, the ink tube is less prone to project above and out of the end portion of the window and less prone to be caught at the end portion of the window. Further, even if the ink tube projects above and out of the window and moves atop the cover body, it can be easily returned inside the recording unit via the window. Thus, the carriage can be normally moved in the main scanning direction, and damage to the ink tube can be prevented.

Preferably, in the printer according to the invention, a guide portion that guides the ink tube downward when the carriage is moved in the main scanning direction may be provided around an edge portion of the window of the cover body. When the carriage is moved in the main scanning direction and the ink tube is moved in conjunction with the carriage and nearly projects out from the window, the guide portion guides the ink tube downward to protect the ink tube from projecting out from the window.

Further, in the printer according to the invention, it is preferable that the window of the cover body is defined in such a shape as to be able to cover the upper portion of the fixing portion with the cover body. Inside the recording unit, the ink tube of which is fixed at the fixing portion can be covered with the cover body, so that the ink tube is less prone to project out from the window.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described in detail with reference to the accompanying drawings. In the embodiment, the invention is applied to a multifunction apparatus that includes various functions, such as a telephone, a facsimile machine, a printer, a scanner, and a copier. However, it can be applied to any printing apparatus using liquid ink printing.

Figure 1:
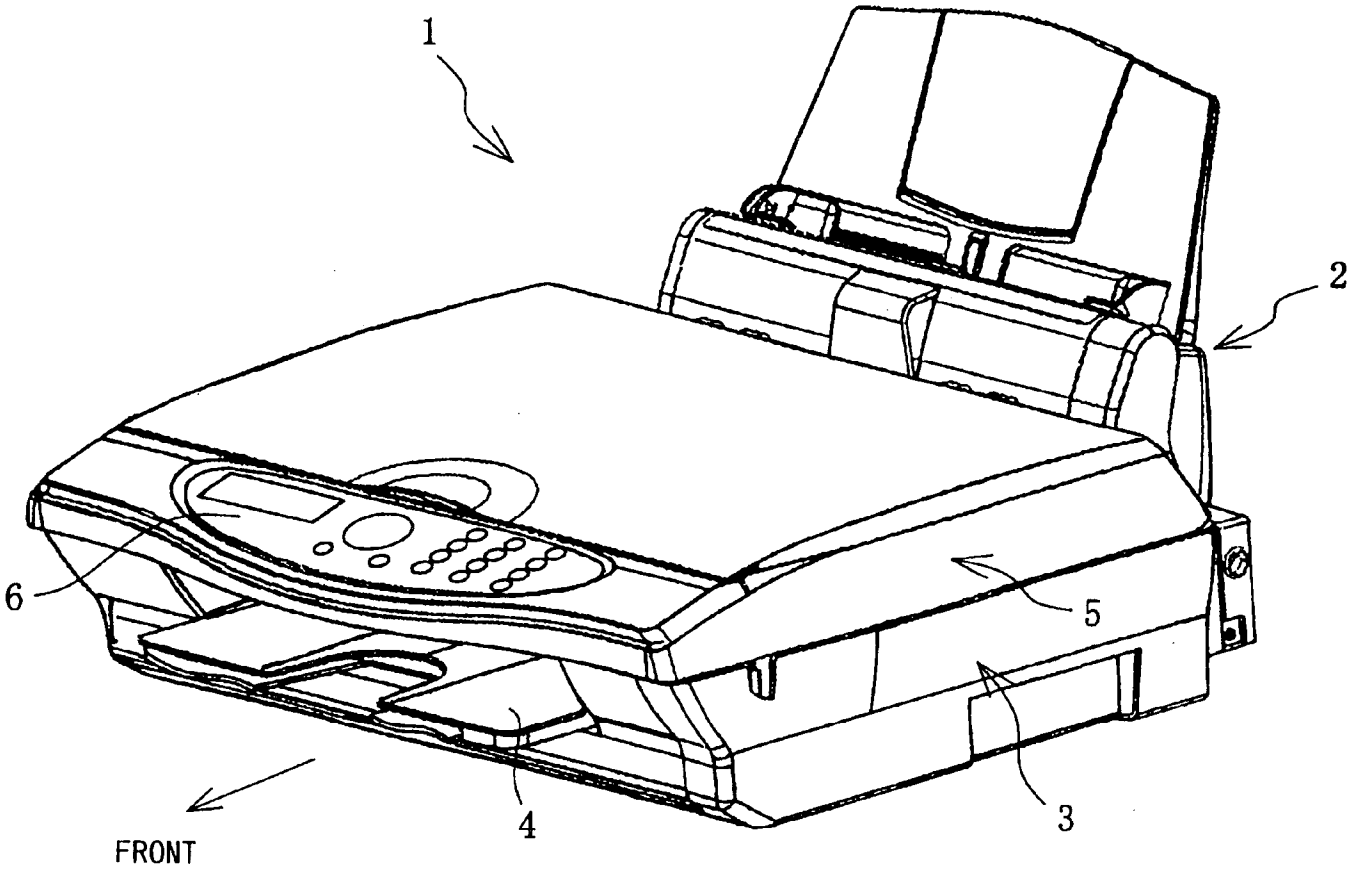
FIG. 1 is a perspective view of a multifunction apparatus according to an embodiment of the invention.

As shown in FIG. 1, a multifunction apparatus 1 is provided with a paper feed unit 2 disposed at an rear end thereof, a printer 3 disposed at a front bottom part of the paper feed unit 2, a discharge paper tray 4 disposed at the front of a recording unit (FIG. 2) of the printer 3, a scanner 5 disposed on the printer 3, and an operation panel 6 disposed at the front end of and on the top surface of the scanner 5.

The printer 3 will be described. As shown in FIGS. 2 to 6, the printer 3 includes a print head 10, a carriage 11 that mounts the print head 10, a guide mechanism 12 that guides and supports the carriage 11 so as to be movable to the right and left (a main scanning direction) directions, and a carriage moving mechanism 13 that moves the carriage 11 to the right and left. A recording unit 14 is made up of the print head 10, the carriage 11, the guide mechanism 12, the carriage moving mechanism 13, and a recording unit frame 15. The recording unit frame 15 takes the form of a rectangular box, where the print head 10, the carriage 11, the guide mechanism 12, and the carriage moving mechanism 13 are arranged.

As shown in FIGS. 2 to 10, in the recording unit frame 15 of the recording unit 14, the guide mechanism 12 and the carriage moving mechanism 13 are attached thereto, and recording is made onto a recording sheet by the print head 10. The recording unit frame 15 (FIG. 7) includes a metal frame 20 having an opening 20*a* on its top surface, and a metal cover body 30 having a window 35. The cover body 30 is fixed to the frame 20 in such a manner as to block the opening 20*a*. The window 35 enables a user to have access to recording sheets in the frame 20.

The frame 20 includes a main frame 21 having a bottom plate 21*a* and a rear side plate 21*b*, a pair of side frames 22, 23, and a front frame 24. These frames 21 to 24 are connected with screws, so that they have an open-topped construction. Flanges 22*a*, 23*a* of the side frames 22, 23 are fixedly attached to a frame attaching portion 1*a* a of the printer 3 by a pair of screws 29.

The cover body 30 has a top plate 30*a* in which the window 35 is defined and a gate-shaped front plate 30*b*. The top plate 30*a* of the cover body 30 is fixed at least to an upper end of the rear side plate 21*b* of the main frame 21 by screws 31. A pair of fixing pieces 30*c* of the front plate 30*b* of the cover body 30 are in abutment with the front frame 24 from the front and fixed thereto with a pair of screws 32.

The rear side plate 21*b* of the main frame 21 has an opening 25 (FIG. 4), through which a sheet with a width little larger than that of A4-size paper is fed. The front frame 24 has an opening 26 (FIG. 3), through which a sheet with a width little larger than that of A4-size paper is discharged. The front plate 30*b* of the cover body 30 has an opening 27 (FIG. 3), which is slightly larger than the opening 26.

A sheet supplied by the paper feed unit 2 is brought from the opening 25 into the inside of the recording unit frame 15, fed forward by a sheet conveying mechanism 16 having a conveying roller 74, and discharged through the openings 26, 27 to the discharge paper tray 4. Thus, the recording sheet is fed so as to pass under the print head 10 in the frame 20, and the print head 10 performs recording (printing) onto the sheet in a downward direction.

Figure 2:
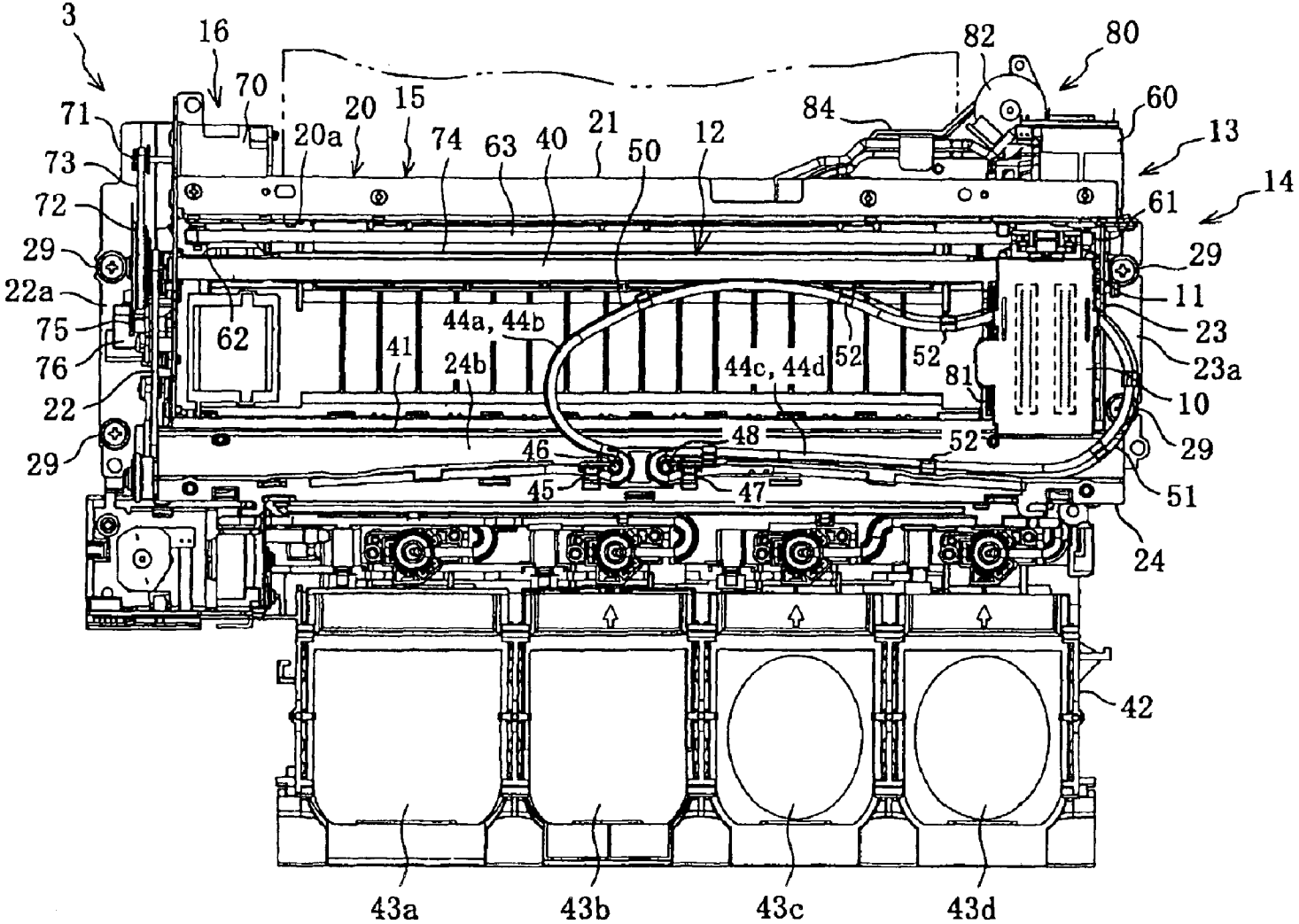
FIG. 2 is a plan view of a recording unit in a condition where a cover body is removed.
Figure 3:
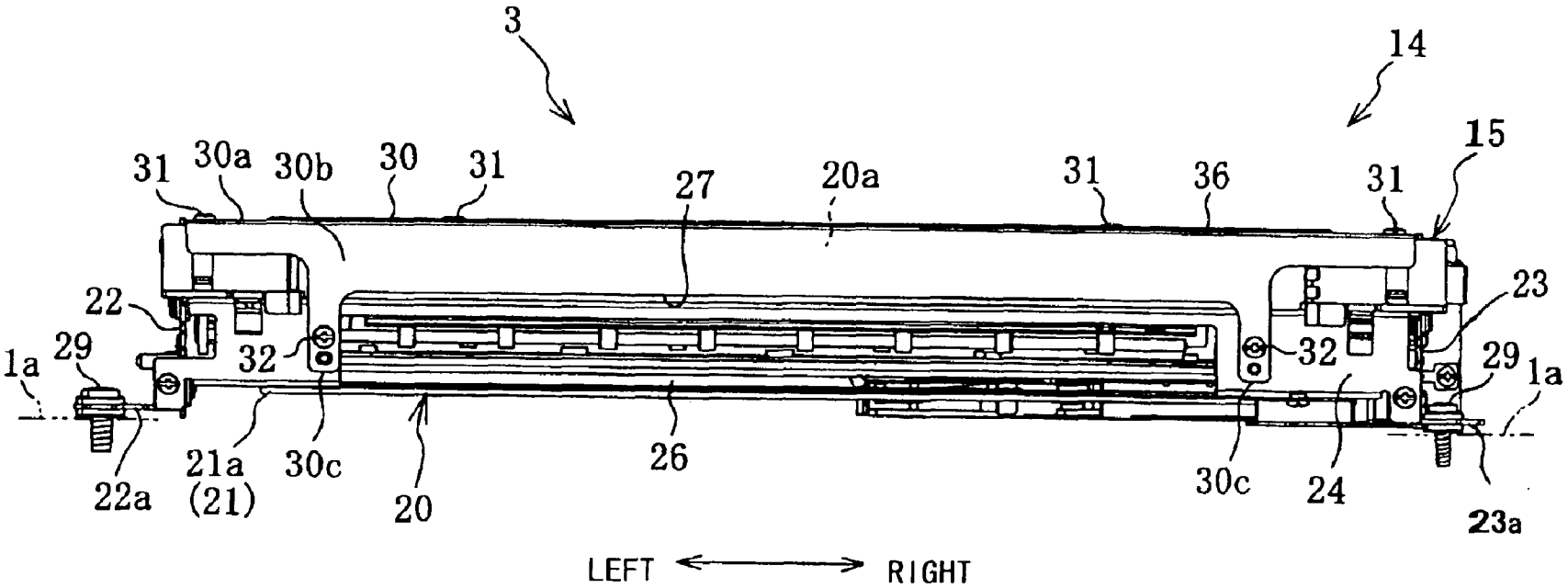
FIG. 3 is a front view of the recording unit and a frame thereof.
Figure 9:
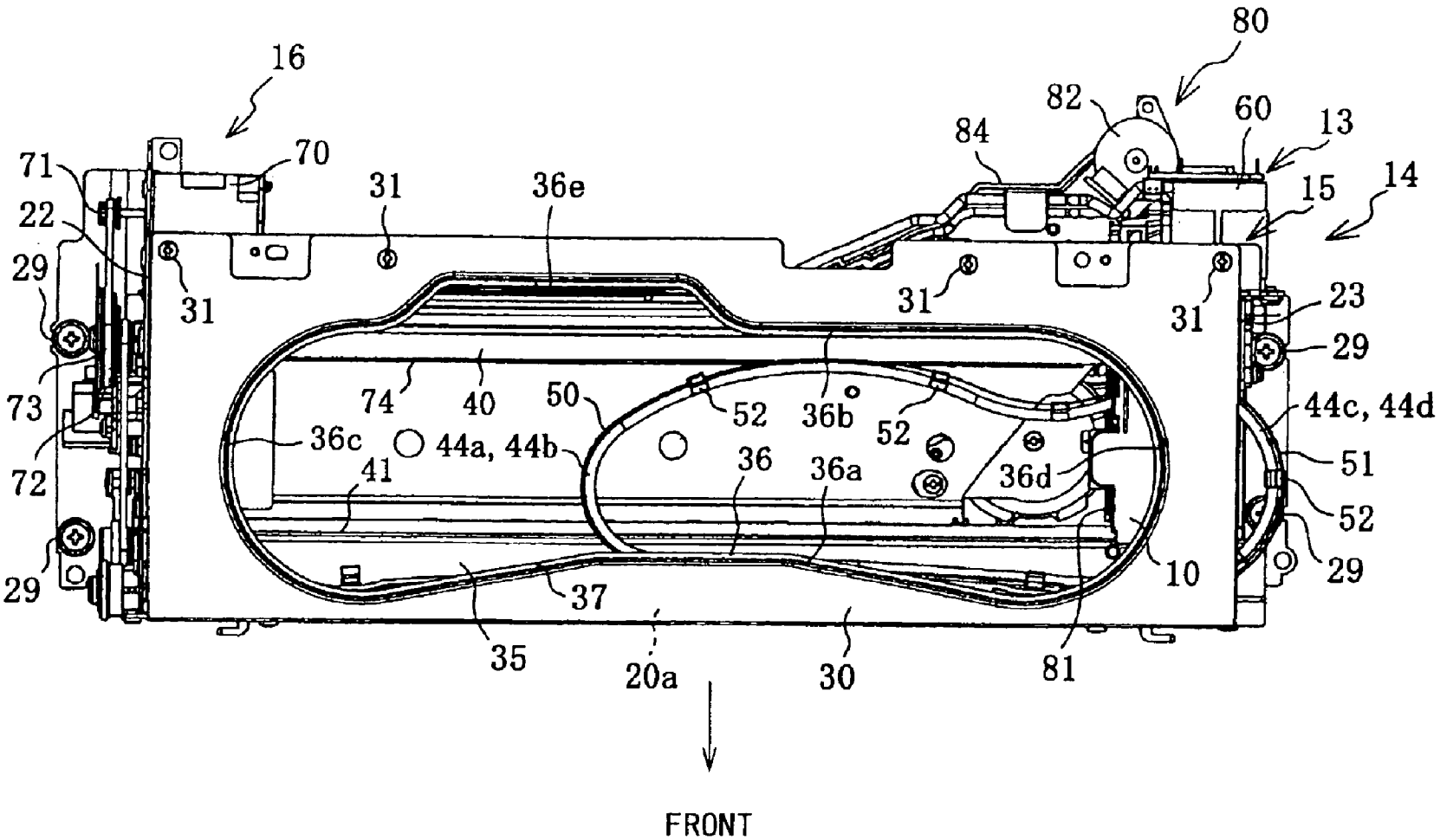
FIG. 9 is a plan view of the recording unit and the frame.
Figure 10:
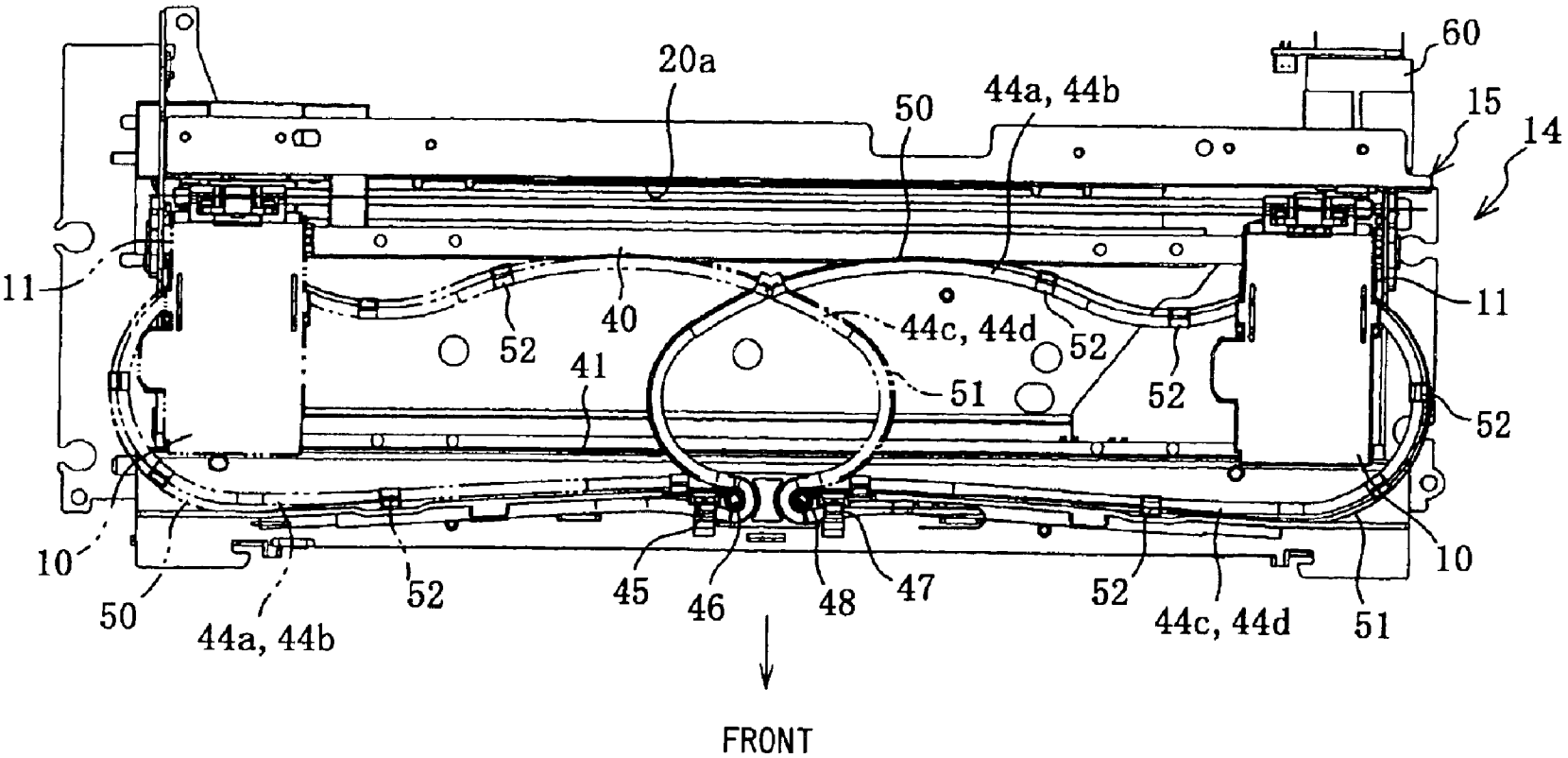
FIG. 10 is a plan view of the recording unit in a condition where the cover is removed.

As shown in FIGS. 2, 9, and 10, the guide mechanism 12 has a guide shaft 40 and a guide rail 41. The guide shaft 40 is disposed in the rearward part of the frame 20 with its ends coupled to the side frames 22, 23. The guide rail 41 is disposed in the forward part of the frame 20. The guide rail 41 comprises the front end of a horizontal part 24*b* made by folding the upper part of the front frame 24 rearward. The rear end part of the carriage 11 is slidably fit on the guide rail 40, and the front end part of the print head 10 mounted on the carriage 11 is slidably engaged to the guide rail 41.

The print head 10 is provided with four groups of nozzles facing downward. Four inks (black, cyan, yellow, and magenta) are discharged downward from the four groups of nozzles, so that printing is made on a sheet. As shown in FIG. 2, a cartridge mounting portion 42 is provided under the discharge paper tray 4 outside the recording unit frame 15. Four colors of inks are supplied from four cartridges 43*a* to 43*d* received on the cartridge mounting portion 42 through four flexible ink tubes 44*a* to 44*d* to the print head 10.

As shown in FIGS. 2 and 10, the two ink tubes 44*a*, 44*b* extending from two left ink cartridges 43*a*, 43*b* are guided inside of the frame 20 from the left, and fixed halfway to a fixing portion 45 located at substantially a center of the horizontal part 24*b* of the front frame 24. The ink tubes 44*a*, 44*b* curve leftward at the fixing portion 45, and extend curvedly to the print head 10.

In contrast to the ink tubes 44*a*, 44*b*, the two ink tubes 44*c*, 44*d* extending from two right ink cartridges 43*c*, 43*d* are guided inside of the recording unit 14 from the right, and fixed halfway to a fixing portion 47 located at substantially a center of the horizontal part 24*b* of the front frame 24. The ink tubes 44*c*, 44*d* curve rightward at the fixing portion 47, and extend curvedly to the print head 10.

As shown in FIGS. 2 and 10, two flexible printed circuits (FPC) 50, 51 extending horizontally and flexibly are connected to the print head 10. The left FPC 50 is fixed halfway to a fixing portion 46 provided close to the fixing portion 45. The FPC 50 curves leftward along the two ink tubes 44*a*, 44*b* at the fixing portion 46 and extends to the print head 10.

The right FPC 51 is fixed halfway to a fixing portion 48 provided close to the fixing portion 47. The FPC 51 curves rightward along the two ink tubes 44*c*, 44*d* at the fixing portion 48 and extends to the print head 10. The FPC 50, 51 extend from a control apparatus disposed under the recording unit frame 15 and are guided inside the recording unit frame 15. The FPC 50, 51 each include a plurality of control signals electronically connected to the control apparatus and the print head 10.

Figure 11:
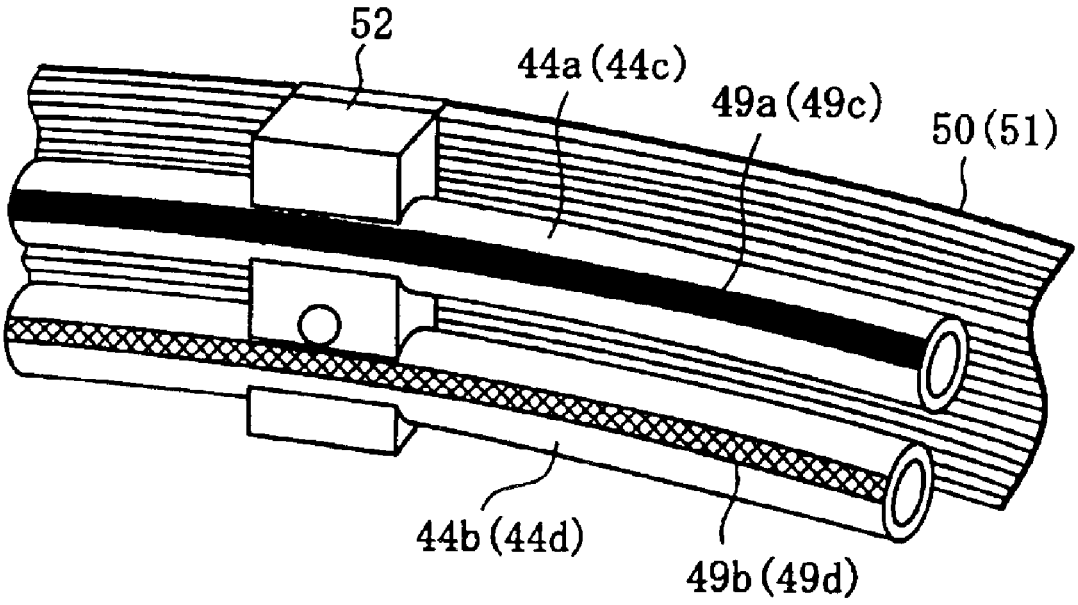
FIG. 11 is a perspective view of essential parts of ink tubes and a flexible printed circuit (FPC).

As shown in FIGS. 2, 10 and 11, a plurality of tube clips 52 made of synthetic resin are detachably attached to the FPC 50, 51. Each two ink tubes 44*a*, 44*b* or 44*c*, 44*d* are tied together by the clips 52. Thus, each two ink tubes 44*a*, 44*b* or 44*c*, 44*d* are integral with FPC 50 or 51 respectively at the fixing portion 46 or 48 and connected to the print head 10.

As shown in FIG. 11, each ink tube 44*a*–44*d* has a straight line mark 49*a*–49*d* the color of which is the same as the corresponding ink tube 44*a*–44*d*. If the ink tubes are twisted, they may sustain resistance while the carriage 11 is moved, and be prone to suffering degradation and breaking. When the straight line mark 49*a*–49*d* is placed without kink or twist, the corresponding ink tube 44*a*–44*d* is also placed without kink or twist.

Figure 4:
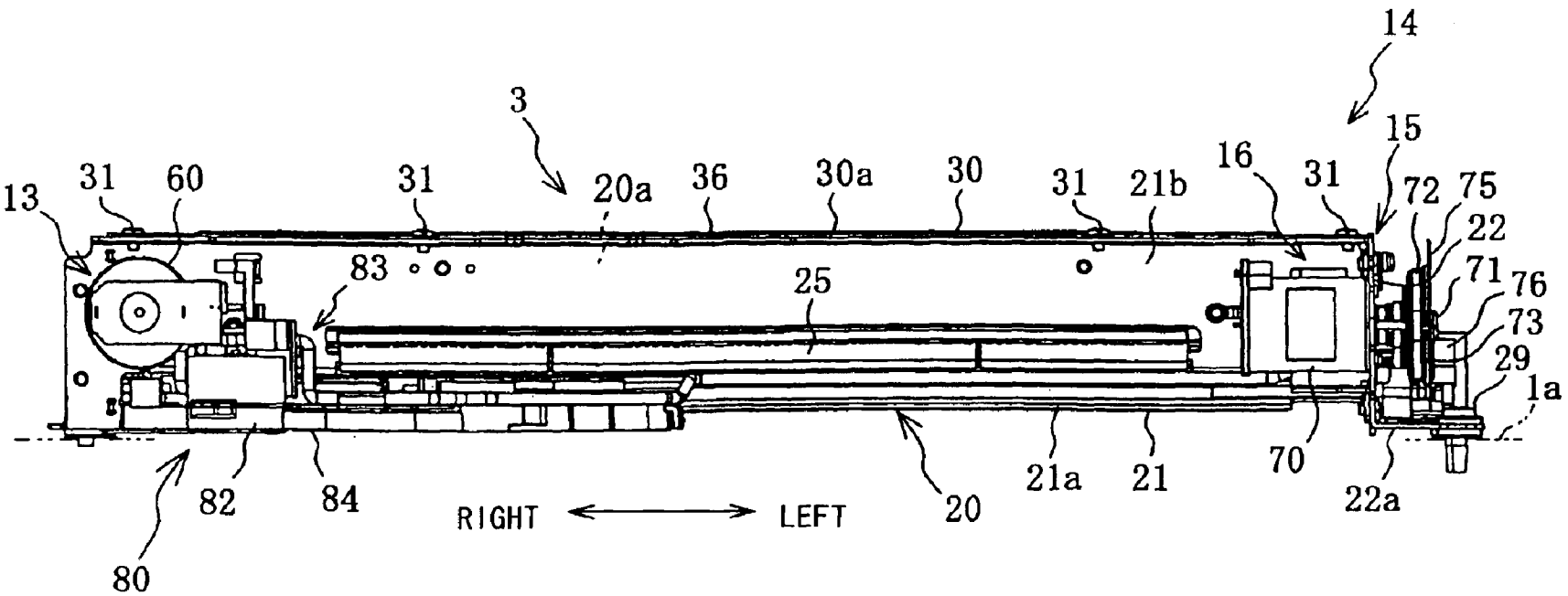
FIG. 4 is a rear elevation of the recording unit and the frame.
Figure 6:
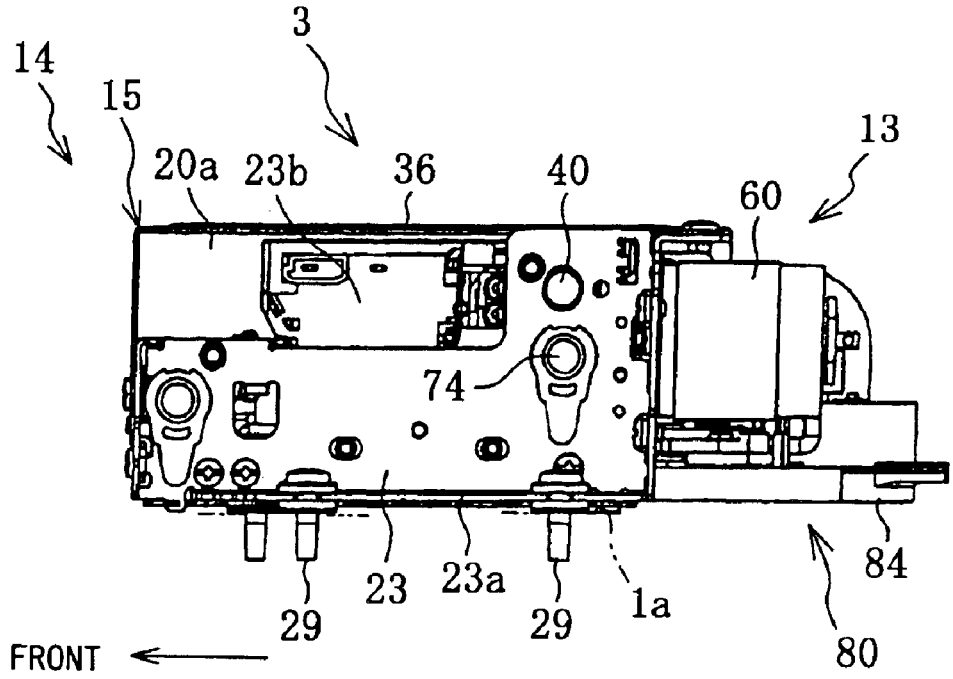
FIG. 6 is a right side view of the recording unit and the frame.

As shown in FIGS. 2, 4 and 6, the carriage moving mechanism 13 is made up of a carriage motor 60, a drive pulley 61, a driven pulley 62, and a belt 63. The carriage motor 60 faces the front and is attached to the rear side plate 21*b* of the main frame 21 at the right end, toward the rear. The drive pulley 61 is rotated by the carriage motor 60. The driven pulley 62 is rotatably supported by the rear side plate 21*b* at the right end, toward the rear. The belt 63 is looped around the drive pulley 61 and the driven pulley 62, and fixed to the carriage 11.

Figure 5:
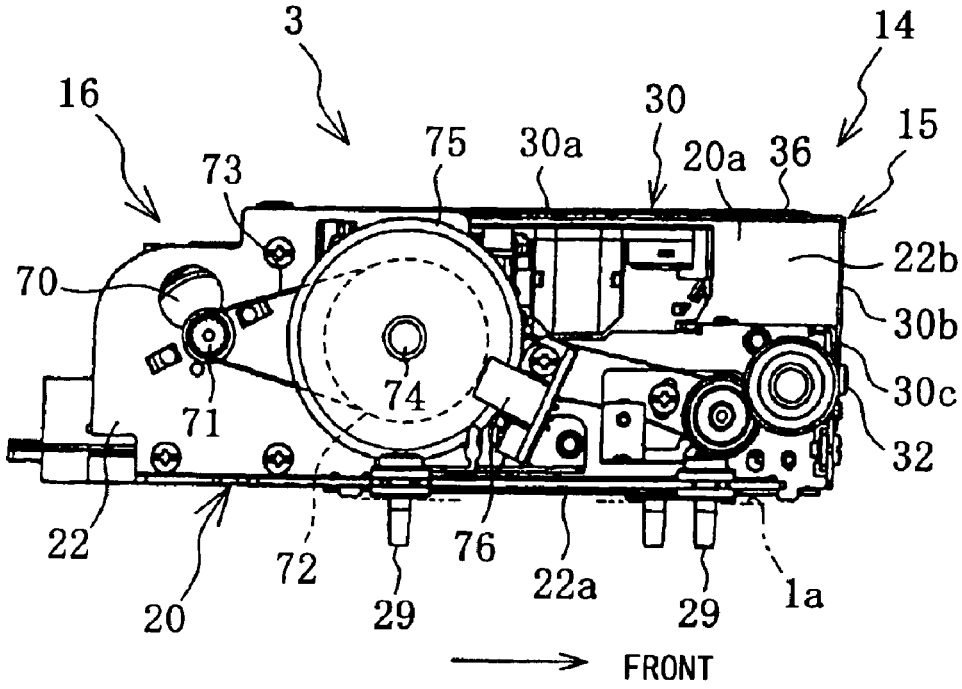
FIG. 5 is a left side view of the recording unit and the frame.

As shown in FIGS. 2, 4 and 5, the sheet conveying mechanism 16 includes a feed motor 70, a drive pulley 71, a driven pulley 72, a belt 73, and the conveying roller 74. The feed motor 70, facing left, is attached to and toward the inside rear of the side frame 22. The drive pulley 71 is rotated by the feed motor 70. The driven pulley 72 is disposed on the outside of the side frame 22. The belt 73 is looped around the drive pulley 71 and the driven pulley 72. The conveying roller 74 is coupled to the driven pulley 72, and disposed under the guide shaft 40 inside the frame 20 such that its right and left ends are rotatably supported by the side frames 22, 23. An encoder disk 75 is fixed to the driven pulley 72, and a photo interrupter 76, which receives the encoder disk 75 therein, is attached to the side frame 22.

As shown in FIGS. 2, 4, 6 and 9, a maintenance unit 80 is disposed at the lower right portion of the frame 20, toward the rear. The maintenance unit 80 has two caps (not shown), a wiper 81, and a drive motor 82. Each of the two caps seals adjacent two groups of nozzles from the bottom. The wiper 81 wipes the head surface of the print head 10. The caps and the wiper 81 are vertically operated by the drive motor 82. The maintenance unit 80 is assembled to a maintenance frame 84, which is fixed to the frame 20.

The cover body 30 and the window 35 will be described in detail. The cover body 30 is connected to the upper end of the frame 20 so as to block a part of the opening 20*a* of the frame 20. The cover body 30 has the top plate 30*a* and the front plate 30*b*, and the top plate 30*a* is formed with the window 35 of which the length is close to the movable stroke of the carriage 11.

The movable stroke of the carriage 11 is a stroke where the print head 10 mounted on the carriage 11 moves across the printable width of A4-size (or any size) paper, which is fed forward in portrait orientation. The recording unit frame 15 has a length greater than the stroke. The window 35 has a width greater than the width of A4-size paper in portrait orientation.

Figure 7:
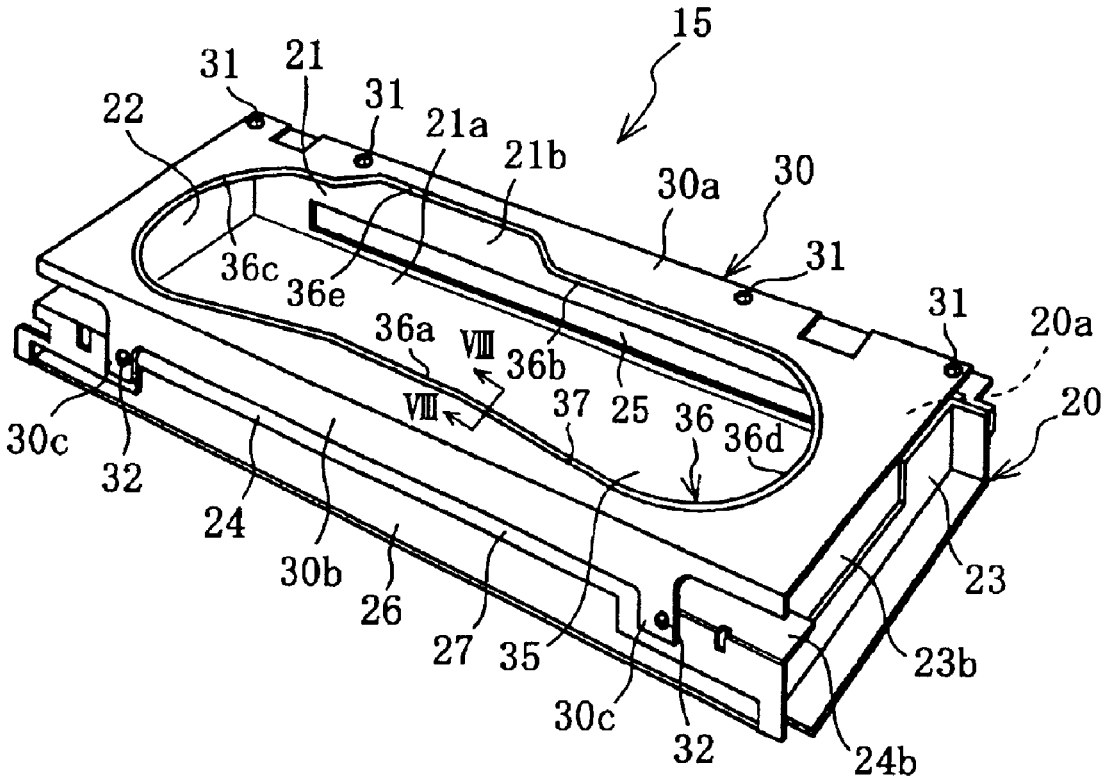
FIG. 7 is a perspective view of a recording unit frame.
Figure 8:
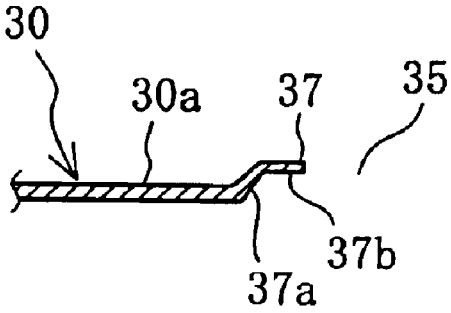
FIG. 8 is a cross sectional view taken along the line VIII—VIII of FIG. 7.

As shown in FIGS. 7 to 9, an edge portion 36 of the window 35 is made up of a front edge portion 36*a*, a rear edge portion 36*b*, a left edge portion 36*c*, and a right edge portion 36*d*. The rear edge portion 36*b* includes a recessed portion 36*e*, which is recessed rearward on the left side. The left edge portion 36*c* and the right edge portion 36*d* of the window 35 are formed in a round shape similar to the curves of the ink tubes 44*a*, 44*b* or 44*c*, 44*d* (and the FPC 50 or 51) which approach the edge portion 36 of the window 35.

When the cover body 30 is fixed to the frame 20 as described above, all parts of the cover body 30 other than the window 35 function as reinforcement, which braces the frame 20 and provides greater rigidity and strength in the recording unit frame 15. A solid line in FIG. 10 shows a condition where the print head 10 and the carriage 11 are fully moved to the right (its home position). When the carriage 11 is moved therefrom to the left by approximately a quarter of the movable stroke, the ink tubes 44*c*, 44*d* approach the right edge portion 36*d*. Therefore, the right edge portion 36*d* is formed in a round shape similar to the curves of the ink tubes 44*c*, 44*d*.

A chain line in FIG. 10 shows a condition where the print head 10 and the carriage 11 are fully moved to the left. When the carriage 11 is moved therefrom to the right by approximately a quarter of the movable stroke, the ink tubes 44*a*, 44*b* approach the left edge portion 36*c*. Therefore, the left edge portion 36*c* is formed in a round shape similar to the curves of the ink tubes 44*a*, 44*b*.

As shown in FIG. 10, when the print head 10 and the carriage 11 are substantially fully moved to the left or right, the ink tubes 44*a*, 44*b* or 44*c*, 44*d* and the FPC 50 or 51 are pushed toward the side frames 22, 23 leftward or rightward. To make allowance for where the ink tubes 44*a* to 44*d* and the FPCs 50, 51 are pushed toward the side frames 22, 23, the front part of each of the side frames 22, 23 is stepped to provide openings 22*b*, 23*b* between the side frames 22, 23 and the cover body 30 (FIGS. 5, 6). The openings 22*b*, 23*b* allow the curves of the ink tubes 44*a*, 44*b* or 44*c*, 44*d* and the FPC 50 or 51 to escape outwardly, whereby the carriage 11 avoids resistance caused by the curves and smoothly moves sideways. Further, the side frames 22, 23 do not obstruct the curves of the ink tubes 44*a* to 44*d* and the FPC 50, 51, whereby preventing the ink tubes and the FPC from being broken or damaged.

The edge portion 36 of the window 35 is provided with a guide portion 37 so as to guide the ink tubes 44*a* to 44*d* and the FPC 50, 51 downward, so that the ink tubes 44*a* to 44*d* and the FPC 50, 51 can be prevented from projecting above the window 35 when the carriage 11 is moved sideways. The guide portion 37 is structured so as to prevent the ink tubes 44*a*, 44*b*, or 44*c*, 44*d*, and the FPC 50 or 51, which are connected to either side of the print head 10 with respect to the scanning direction, from projecting above the window 35 when the carriage 11 is moved from one end to the other end.

As shown in FIG. 8, the guide portion 37 has a slanting portion 37*a* that slants upward toward the window 35 of the cover body 30 and a flat portion 37*b* that extends toward the window 35 from the slanting portion 37*a*. The guide portion 37 is formed such as to be narrowed down around the edge portion 36. With this structure, the guide portion 37 serves both as the guide function described above and the reinforcement function of the cover body 30 and, in short, the recording unit frame 15.

The front edge portion 36*a* of the window 35 extends slightly rearward at its central portion, which is positioned above the fixing portions 45, 47 for the ink tubes 44*a* to 44*d* and the fixing portions 46, 48 for the FPC 50, 51. That is, the window 35 of the cover body 30 is defined such that the cover body 30 can cover the upper portions of the fixing portions 45 to 48. This prevents the ink tubes 44*a* to 44*d* from being lifted and released from the fixing portions 46, 48.

The operation and effect of the printer 3 will be described. The recording unit 14 is made up of the print head 10, the carriage 11, the guide mechanism 12, the carriage moving mechanism 13, and the recording unit frame 15. The guide mechanism 12 and the carriage moving mechanism 13 are attached to the recording unit frame 15, inside of which the print head 10 performs printing onto a sheet. The recording unit frame 15 includes at least the frame 20 having the opening 20*a* on its top and the cover body 30 having the window 35 that enables a user to have access to the recording sheets in the frame 20. The cover body 30 is fixed to the frame 20 so as to cover a part of the opening 20*a*.

The cover body 30 is fixed to the frame 20 of the recording unit frame 15 so as to block a part of the opening 20*a*, thereby reinforcing the frame 20, and providing greater rigidity and strength to the frame 20 and, that is, to the recording unit frame 15.

In the embodiment, the height of the recording unit 14 is reduced by placing the ink cartridges 43*a* to 43*d* outside of the recording unit 14 to supply ink to the print head 10 via the ink tubes 44*a* to 44*d*. In this case, if the structure of the recording unit frame 15 is made up of only the frame 20 having the opening 20*a*, i.e., the same as the conventional device described in the Background, rigidity and strength of the frame 20 may be lowered and become impracticable, and the frame 20 may become kinked or twisted, thereby leading to a reduction in print quality.

In the embodiment, the recording unit frame 15 is constructed by fixing the cover unit 30 to the frame 20. Even though the height of the recording unit frame 15 is decreased, great rigidity and strength of the recording unit frame 15 can be ensured thereby reducing the tendency to form a kink or twist in the recording unit frame 15 fixed to the frame attaching portion 1*a*. The movement path of the print head 10 is normalized. Thus, it is possible to maintain high print quality.

Further, the cover body 30 has the relatively large window 35 of which the width is substantially the same as the moving stroke of the carriage 11. Therefore, when a paper jam occurs, it is possible to easily remove a paper jammed inside the recording unit frame 15 through the window 35.

The fixing portions 45, 47 for fixing the ink tubes 44*a* to 44*d*, which each extend from the ink cartridges 43*a* to 43*d* received in the cartridge mounting portion 42 placed outside the recording unit 14 to the print head 10, are disposed inside the recording unit 14, and the ink tubes 44*a* to 44*d* are curved from the fixing portions 45, 47 and arranged so as to extend to the print head 10. Thus, the ink tubes 44*a* to 44*d* can be neatly arranged in the recording unit frame 15.

In addition, the fixing portions 46, 48 for fixing the FPC 50, 51, which are flexible and extend to the print head 10, are disposed inside the recording unit 14, and the FPC 50, 51 are arranged such that they are curved from the fixing portions 46, 48 and extend to the print head 10 along the ink tubes 44*a* to 44*d*. Thus, the FPC 50, 51 as well as the ink tubes 44*a* to 44*d* can be neatly arranged in the recording unit frame 15.

Both end portions 36*c*, 36*d* of the window 35 in the cover body 30, with respect to the main scanning direction, are formed in a curved shape similar to the curves of the ink tubes 44*a* to 44*d* and the FPC 50, 51, which approach the end portions 36*c*, 36*d* of the window 35. Therefore, the ink tubes 44*a* to 44*d* and the FPC 50, 51 are less prone to project upward from either end portion 36*c*, 36*d* of the window 35 and less prone to be caught at either end portion 36*c*, 36*d* of the window 35. Further, even if the ink tubes 44*a* to 44*d* and the FPC 50, 51 project upward from the window 35 to move onto the top of the cover body 30, they can easily return from the window 35 to the inside of the recording unit 14 when the carriage 11 and the print head 10 are moved sideways.

The guide portion 37 is provided around the edge portion 36 of the window 35 in the cover body 30 so as to guide the ink tubes 44*a* to 44*d* and the FPC 50, 51 downward to prevent their projecting upward from the window 35 when the carriage 11 is moved sideways. Therefore, even when the ink tubes 44*a* to 44*d* and the FPC 50, 51 are about to project upward from the window 35, they are guided downward by the guide portion 37, so that they are prevented from projecting upward from the window 35.

The window 35 has such a shape that the cover body 30 can cover the fixing portions 45 to 48 from above. As the ink tubes 44*a* to 44*d* and the FPC 50, 51 are fixed by the fixing portions 45 to 48 in the recording unit frame 15 and the fixing portions 45 to 48 are covered by the cover body 30, the ink tubes 44*a* to 44*d* and the FPC 50, 51 are less prone to protrude upward from the window 35.

As the ink tubes 44*a* to 44*d*, and the FPC 50, 51, can be held so as not to protrude from the window 35 as described above, the carriage 11 can be normally moved sideways. The guide portion 37 serves for both the guiding function and the reinforcement of the cover body 30, and enhances the rigidity and strength of the recording unit frame 15.

Due to the rear recessed portion 36*e* of the edge portion 36 in the window 35 of the cover body 30, the distance between the rear recessed portion 36*e* and the front edge portion 36*a* is greater than other distances therein, which facilitates replacement of the print head 10 mounted in the recording unit frame 15.

As each ink tube 44*a* to 44*d* has a straight line mark 49*a* to 49*d* of the same color as the ink in corresponding ink tube 44*a* to 44*d*, they can be positioned without a kink or twist by placing the straight line marks 49*a* to 49*d* so as not to be kinked or twisted.

A conventional problem is that it is difficult to dispose separate ink tubes 44*a* to 44*d* without a kink, or twist, when they are connected to the cartridge mounting portion 42 and the print head 10. It is conceivable that a thick tube made up of at least two ink tubes arranged adjacently may be used instead of the separate ink tubes. However, it is more difficult to insert such a thick tube into the recording unit frame 15 from the cartridge mounting portion 42 than is the case with the single ink tubes 44*a* to 44*d*. Further, the thick tube has high stiffness. When the thick tube is disposed in the recording unit frame 15, it may interfere with the sideways movement of the carriage 11.

The above problems can be solved by providing the ink tubes 44*a* to 44*d* with the straight line marks 49*a* to 49*d* as in the embodiment. The ink tubes 44*a* to 44*d* can be easily and reliably arranged without kink or twist by keeping the straight line marks 49*a* to 49*d* from being kinked or twisted. Furthermore, each of the straight line marks 49*a* to 49*d* formed on the ink tubes 44*a* to 44*d* is indicated with the corresponding ink color, which simplifies connection of the ink tubes 44*a* to 44*d*. Thus, the ink tubes 44*a* to 44*d* can be connected easily and reliably.

The ink tubes 44*a* to 44*d* are extruded parts. While they are extruded in the extrusion process, a paint roller containing paint may be pressed against each surface to form the straight line marks 49*a* to 49*d*. By doing so, it is possible to simply form the straight line marks 49*a* to 49*d* for keeping the ink tubes 44*a* to 44*d* from being kinked or twisted.

If the purpose is only to prevent ink tubes 44*a* to 44*d* from being kinked or twisted, it is not necessary to paint the straight line marks 49*a* to 49*d* with the same colors as those of the corresponding inks in the ink tubes 44*a* to 44*d*. The straight line marks 49*a* to 49*d* may be painted with colors different from those of the inks contained in the ink tubes 44*a* to 44*d*. This setting also allows the user to check whether the ink tubes 44*a* to 44*d* are arranged without kink or twist.

The ink tubes 44*a* to 44*d* may be opaque (translucent) and the straight line marks 49*a* to 49*d* may be transparent. Alternatively, the ink tubes 44*a* to 44*d* may be transparent and the straight line marks 49*a* to 49*d* may be opaque. With such structures, the ink colors can be visually checked through the transparent part, and checking whether the ink tubes 44*a* to 44*d* are arranged without kink, or twist, can be made at the boundary between the transparent part and the opaque part.

The structure of the recording unit frame having the frame and the cover body, the structure of the cover body including the shape of the opening are not limited to the recording unit frame 15 and the window 35 in the embodiment, but may be applied to various structures.

While the invention has been described with reference to a specific embodiment, the description of the embodiment is illustrative only and is not to be construed as limiting the scope of the invention. Various other modifications and changes may occur to those skilled in the art without departing from the spirit and scope of the invention.

What is claimed is:

1. A printer comprising a recording unit including a print head that prints onto a recording sheet, a carriage that has the print head thereon, a guide mechanism that guides and supports the carriage in a main scanning direction, and a carriage moving mechanism that moves the carriage in the main scanning direction, the recording unit comprising:

a frame that surrounds a scanning range of the carriage in which the print head performs printing onto a recording sheet, the guide mechanism and the carriage moving mechanism attached to the frame, the frame having at least an opening on a top thereof; and a cover body that is fixed to the frame so as to block a part of the opening of the frame and that has a window that enables a user to have access to a recording sheet within the frame, wherein the window of the cover body is elongated in the main scanning direction with an edge having curved ends and a length greater than a width of the recording sheet.

2. The printer according to claim 1, further comprising:

an ink cartridge that supplies ink to the print head; and a cartridge mounting portion that is provided outside the recording unit and to which the ink cartridge is mounted, wherein the recording unit is provided with a flexible ink tube that extends from the ink cartridge to the print head and a fixing portion that fixes a middle of the ink tube, the ink tube gets curved from the fixing portion and extends to the print head, and the window of the cover body is defined such that at least the curved ends of the window with respect to the main scanning direction are formed in a shape similar to a curve in the ink tube approaching the end portion of the window.

3. The printer according to claim 2, wherein the recording unit is provided with a flexible wiring material for transmitting a drive command that extends to the print head, the fixing portion fixes a middle of the flexible wiring material as well as the middle of the ink tube, and the wiring material is disposed such that it gets curved from the fixing portion along the ink tube and extends to the print head.

4. The printer according to claim 3, wherein the wiring material is attached to the ink tube such as to be situated toward a side where the ink tube bends.

5. The printer according to claim 2, wherein the fixing portion is disposed substantially in a central position of the printer with respect to the scanning direction and out of the scanning area of the carriage.

6. The printer according to claim 2, wherein the frame has openings on both ends through which the curved ink tube passes when the carriage is moved to either side of the frame.

7. The printer according to claim 2, wherein a guide portion that guides the ink tube downward when the carriage is moved in the main scanning direction is provided around an edge portion of the window of the cover body.

8. The printer according to claim 6, wherein the guide portion has a shape such that the edge portion of the window of the cover is formed with a slanting portion toward the window and a step continuing from the slanting portion.

9. The printer according to claim 2, wherein the edge portion of the window of the cover body has a shape capable of covering at least an upper part of the fixing portion with the cover body.

10. The printer according to claim 1, wherein the frame includes a front wall that extends along the scanning direction of the carriage and a rear wall provided facing the front wall, and the cover body connects at least the front wall and the rear wall of the frame.

11. The printer according to claim 9, wherein each of the front wall and the rear wall of the frame has an opening through which a recording sheet passes.

12. The printer according to claim 1, wherein the window of the cover body is defined with the edge portion such as to allow access to the print head only when the carriage is in a specified position.

13. The printer according to claim 2, wherein the print head has a plurality of drive portions partitioned off, the ink tube has a plurality of ink tubes that are individually connected with the plurality of the drive portions so as to supply ink separately according to the drive portions, and that project from a side of the print head, the plurality of ink tubes are arranged in the recording unit so as to extend substantially parallel to each other, and provided with a connector that fixedly maintains the parallel arrangement of the plurality of the ink tubes.

14. The printer according to claim 13, wherein each of the plurality of the ink tubes is formed with a color portion that is colored linearly toward an extension direction thereof.

15. The printer according to claim 14, wherein the print head comprises a color head capable of ejecting a plurality of inks of different colors, the color head has a plurality of drive portions partitioned according to the plurality of the inks of different colors, the ink tube comprises a plurality of ink tubes that are separately provided according to the inks and respectively connected to the plurality of the drive portions, and the color portion provided to each of the ink tubes is colored with a corresponding one of the colors of the inks.

16. A printer using liquid ink, comprising:

an electrical controller;

a metal frame having a front wall, a rear wall and a pair of side walls;

a top plate covering an opening defined by the frame, the top plate attached to at least the front wall and the rear wall and having a window opening therein;

a print carriage casing carrying a print head mounted for reciprocal movement within the metal frame;

at least one ink cartridge mounted to the printer outside the metal frame;

at least one ink tube extending between the at least one ink cartridge and the print head; and at least one flexible printed circuit (FPC) extending between the electrical controller and the print head, wherein the at least one ink tube and the at least one FPC are fixed to the metal frame at entry positions proximate a center of a printing movement range of the carriage, wherein the window opening is elongated in a main scanning direction with an edge having curved ends, a recess adjacent one end and the rear wall of the metal frame, and a projected portion extending from proximate the front wall to overhang the fixing of the at least one ink tube and the at least one FPC to the frame.

17. The printer according to claim 16, wherein the print head prints in a plurality of colors, the at least one ink tube comprises a plurality of ink tubes providing an ink tube for each print color, and the at least one FPC comprises at least two FPC.

18. The printer according to claim 17, wherein each ink tube has a line extending along a length thereof.

19. The printer according to claim 16, wherein the plurality of ink tubes are divided into two ink tube groups, a first ink tube group extending from a first fixing point to one side of the print head and a second ink tube group extending from a second fixing point to an opposite side of the print head, and a first FPC extending from a third fixing point to the one side of the print head and a second FPC extending from a fourth fixing point to the opposite side of the print head, wherein the first ink tube group and the first FPC are joined and the second ink tube group and the second FPC are joined.

* * * * *